United States Patent [19]

Brudi

[11] Patent Number: 4,792,015

[45] Date of Patent: Dec. 20, 1988

[54] AUTOMATIC ESCAPE LADDER

[76] Inventor: Raymond Brudi, 1031 Pine Island Rd., Cape Coral, Fla. 3390

[21] Appl. No.: 104,936

[22] Filed: Oct. 6, 1987

[51] Int. Cl.[4] ..... E06C 9/10; E04F 11/06

[52] U.S. Cl. ..... 182/18; 182/19; 182/81

[58] Field of Search ..... 182/18, 19, 78, 86, 182/81, 77, 79, 80

[56] References Cited

U.S. PATENT DOCUMENTS

| | | | |
|---|---|---|---|
| 623,540 | 4/1899 | Hall | 182/24 |
| 2,321,499 | 6/1943 | Marschke | 182/81 |
| 2,852,176 | 9/1958 | Harmon | 182/78 |
| 3,807,528 | 4/1974 | Frank | 182/81 |
| 3,887,033 | 6/1975 | Breinig | 182/86 |

FOREIGN PATENT DOCUMENTS

| | | | |
|---|---|---|---|
| 242799 | 12/1946 | Switzerland | 182/81 |

*Primary Examiner*—Reinaldo P. Machado
*Attorney, Agent, or Firm*—Leon Gilden

[57] ABSTRACT

An automatic escape ladder is set forth for use particularly in multiple unit, multi-level residential dwellings. A compact interfolded ladder is positionable within an associated enclosure wherein said enclosure includes an upper pivotal portion and a lower portion secured to an extendable ladder. Upon activation through a fire alarm system, a solenoid latch mechanism will release said ladder and said bottom plate enabling said ladder to extend and lock.

5 Claims, 1 Drawing Sheet

10
11
12
13
14
15
16
18
19
20
21
22
23
24
25
4

11
12
18
19
20
21
22
23
24
27

12
18
19
20
21
22
23
24
5

11
12
13
26

19
20
22
23

AUTOMATIC ESCAPE LADDER

BACKGROUND OF THE INVENTION

1. Field of the Invention

The present invention relates to fire escape mechanisms, and more particularly pertains to a new and improved automatic escape ladder which when not utilized, may be interfolded into a compact housing for pre-installation into existing multi-level residential dwellings for effecting subsequent utilization or storing of the same.

2. Description of the Prior Art

The use of escape ladders and the like apparatus is well known in the prior art. As may be appreciated, these devices have normally required a substantial amount of space and as such have been generally opposed to the need to store these devices when not being utilized. Furthermore, during the emergency conditions surrounding a fire or a like emergency situation, it is frequently necessary for such escape mechanisms to be automatically available for users thereof. In this connection, there have been several attempts to develop escape ladder mechanisms which may be easily and efficiently stored when desired and available for subsequent use when necessary. For example, U.S. Pat. No. 4,211,306 to Robert Brenner sets forth the use of emergency escape ladders normally housed within a structure of a multi--level high-rise type building. The ladder is a hinged segmented ladder wherein it may be withdrawn from within the interior of said building and utilized in an emergency thereby. A motorized pulley unit positioned within the ladder compartment feeds the segments out such that they may thereby extend along the side of the building for use. The time delay and excessive space required for the implementation of such a system has rendered the acceptance thereof limited and accordingly maintains a need for a new and improved emergency escape ladder system.

U.S. Pat. No. 4,164,990 to Christian Stiefel discloses a tubular chute dropped from a floor of a cabin positioned somewhat above the ground to enable emergency sliding therethrough. The remoteness of chutes when utilized relative to multi-level apartment buildings and the associated problems therewith render the application of such to mass evacuation devices somewhat limited and accordingly does not provide an improved means of evacuating large numbers of people, as does the instant invention.

U.S. Pat. No. 3,963,097 issued to Richard Fisher sets forth the use of a flexible interlinked fire ladder housed in an overhang that may be released by the actuation resulting from a fire detector electronically associated with an electromechanical release mechanism enabling the flexible ladder to be dropped thereby. Inherent drawbacks in mass evacuation techniques in the employment of flexible ladders and the lack of structural integrity associated with a compartment to house such a ladder yields a somewhat deficient means of providing a secure, effective emergency ladder system for use in multi-level dwellings.

U.S. Pat. No. 8,670,846 to Lorin Jones sets forth a further flexible rope-type ladder for use in a building wherein a closure mechanism upon manual release allows the flexible ropetype ladder to drop. The problems associated with flexible ladders, as noted above, and the particular use of manual means in an emergency situation renders the Jones patent deficient in providing a structurally integral compartmental escape ladder mechanism immediately effective upon the advent of a fire.

U.S. Pat. No. 3,477,548 to Vigluicci provides another compartmentalized escape ladder secured within a cabinet structure that upon manual opening of said cabinet structure yields a fire exit operational to an outside wall enabling immediate escape therethrough. The patent is of relative interest only in that it is a means of providing emergency escape mechanism and is of relative remoteness to the instant invention.

U S. Pat. 3,411,607 to R. Otten sets forth a storable emergency ladder that is normally secured within a compartment in an accordion-like fashion whereas the linked ladder mechanism is manually releasable when needed. The Otten patent is another in a series of manually secured escape ladder mechanisms that have failed to address the problem of secure storage of an escape ladder when not in use and the emergency release thereby of an integral secure ladder when needed.

U.S. Pat. No. 2,709,030 to Broman et al, provides a wall mounted door With an integral associated floor plate that upon manual opening of the door is repositioned within an opening therethrough whereby a folded ladder is extended for escape from an associated building. The Broman patent is merely another in a series of manual escape ladders provided with interfolded ladder mechanisms that are generally lacking in immediacy of operation relative to a fire or emergency situation that may develop within an associated building.

As such it may be appreciated that there is a continuing need for a new and improved emergency escape ladder which addresses both the problem of storage and immediate availability when necessary, and in this respect the present invention substantially fulfills this need.

SUMMARY OF THE INVENTION

In view of the foregoing disadvantages inherent in the known types of automatic escape ladders now present in the prior art, the present invention provides an automatic escape ladders which may be compactly stored when not in use and may be further easily and effectively rendered to operative during periods of use. As such, the general purpose of the present invention, which will be described subsequently in greater detail, is to provide a new and improved automatic escape ladder which has all the advantages of the prior art automatic escape ladders and none of the disadvantages.

To attain this, the present invention comprises a hinged folded ladder securable within a compartment by means of remotely actuable solenoid elements wherein said solenoid elements may be electrically associated with a fire alarm enabling the energization of said solenoid releasing said ladder from within its storage compartment and enabling same to drop by means of gravity to an extended position. A pivotal top plate overlying said ladder in a normal position is pivotal upwardly to gain access to said ladder. A bottom plate secured to an outermost portion of said folded ladder encloses said ladder between said top and bottom plates rendering said ladder so folded inconspicuous from view and only visually apparent when released to said extended position, as noted.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will for the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automatic escape ladder which has all the advantages of the prior art automatic escape ladders and none of the disadvantages.

It is another object of the present invention to provide a new and improved automatic escape ladder which may be easily and efficiently manufactured and marketed.

It is a further object of the present invention to provide a new and improved automatic escape ladder which is of a durable and reliable construction.

An even further object of the present invention is to provide a new and improved automatic escape ladder which is susceptible of a low cost of manufacture with regard to both materials and labor, and which accordingly is then susceptible of low prices of sale to the consuming public, thereby making such automatic escape ladders economically available to the buying public.

Still yet another object of the present invention is to provide a new and improved automatic escape ladder which provides in the apparatuses and methods of the prior art some of the advantages thereof, while simultaneously overcoming some of the disadvantages normally associated therewith.

Still another object of the present invention is to provide a new and improved automatic escape ladder that may be compactly stored when not in use and automatically released when necessary.

Even still another object of the present invention is to provide a new and improved automatic escape ladder wherein a hinged escape ladder is pivotally extensible from a retracted interfolded position within a cabinet-like structure formed with a top and bottom plate positionable within a multi-level dwelling's overhang.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
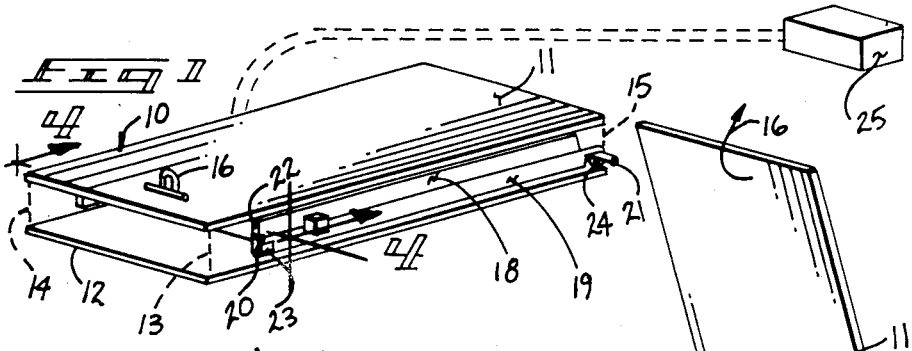
FIG. 1 is an isometric view of the present invention illustrating the automatic escape ladder interfolded within its cabinet-like structure.
Figure 2:
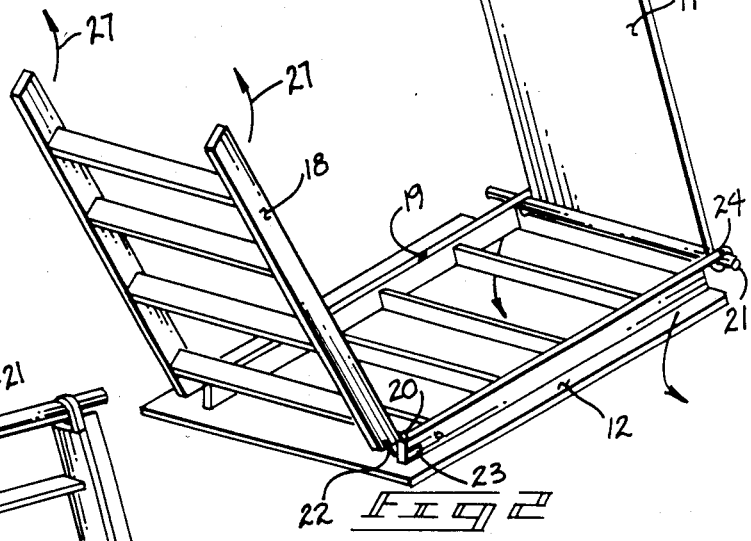
FIG. 2 is an isometric view of the automatic escape ladder of the present invention somewhat expanded illustrating the various parts, their configuration, and relationship.

With reference now to the drawings, and in particular to FIG. 1 thereof, a new and improved automatic escape ladder embodying the principles and concepts of the present invention and generally designated by the reference numeral 10 will be described.

Figure 3:
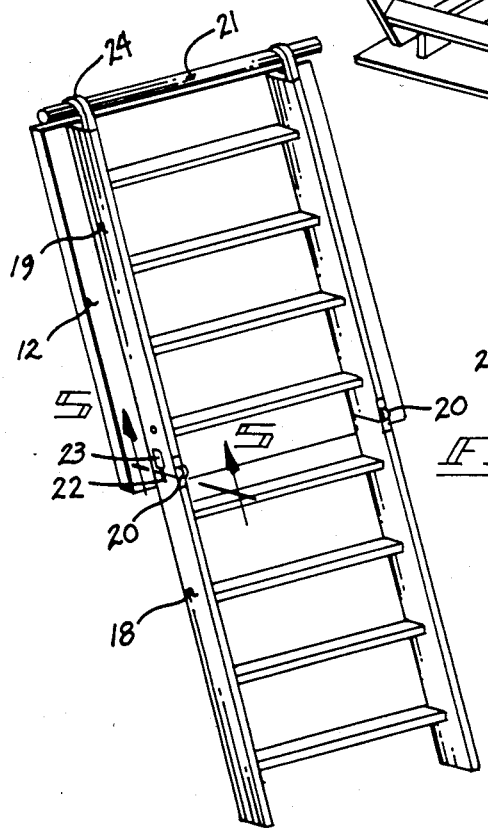
FIG. 3 is an isometric view of the present invention illustrating the ladder extended in use.
Figure 4:
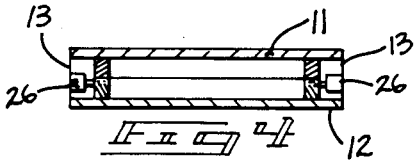
FIG. 4 is an orthographic side view taken along the lines 4—4 of FIG. 1 in the direction indicated by the arrows.
Figure 5:
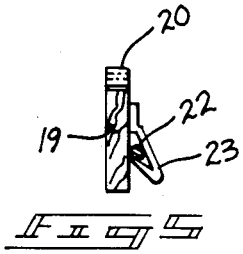
FIG. 5 is an orthographic taken along the lines 5—5 of FIG. 3 in the direction indicated by the arrows.

More specifically, it will be noted that the automatic escape ladder apparatus 10 essentially comprises a cabinet-like structure formed of a top plate 11, a bottom plate 12, side walls 13, a forward wall 14, and a rear wall 15. Top plate 11 is hingedly secured by conventional hardware to rear wall 15 and may be pivotally movable upwardly in the direction indicated by arrow 16 about such hinged connection by means of handle 17. Bottom plate 12 is securedly affixed to bottom portion 19 of the escape ladder. The top portion of the escape ladder 18 is hingedly secured to lower portion 19 by means of ladder hinges 20 enabling top portion to present itself in an overfolded condition within the cabinet-like structure, as illustrated in FIG. 1. Ladder hinges 20 furthermore enable top portion 18 and bottom portion 19 into abutting engagement when in an extended position, as illustrated in FIG. 3. Furthermore, as illustrated in FIG. 5, a spring latch 23 secured to bottom portion 19 engages a locking pin 22 secured to top portion of escape ladder 18 to lock said top and bottom portions into position, as illustrated in FIG. 3.

A pivot hinge axle 21 enables pivoting of said escape ladder by means of an extension loop 24 integrally formed to bottom portion 19.

A fire alarm 25 is electrically associated with solenoids 26, whereupon fire alarm 25 being activated, solenoids 26 will energize withdrawing their shafts from within opening formed in bottom portion of escape ladder 19 enabling said escape ladder to drop by action of gravity thereon whereupon bottom plate 12 will thereafter descent with bottom portion 19 enabling top portion 18 to pivot, as indicated by arrows 27, and lock by means of the aforenoted locking pins 22 and springs latches 23.

The invention is compactly foldable and adaptable thereby for installation in multi-story dwellings and preferably in the overhanging balcony portions thereof whereby the escape ladder formed in the respective overhang will provide access to the overhang or balcony therebelow and ultimately to ground level providing an escape means for the occupants of such a building.

As to the manner of usage and operation of the present invention, the same should be apparent from the above description. Accordingly no further discussion relative the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. An automatic escape ladder apparatus for use in combination with overhanging projections of building structures wherein said apparatus comprises, a foldable ladder means positionable within a cabinet-like structure for securement within said overhanging projections wherein said cabinet-like structure includes a top plate, a bottom plate, a forward wall, a rear wall, and adjoining side walls, and said top plate pivotally mounted to said rear wall;

and said bottom plate fixedly secure to said ladder, and energizable means to release said ladder from within said cabinet-like structure wherein said energizable means includes at least one solenoid means secured to at least one side wall wherein said solenoid means include piston means extending through as opening in said ladder means bottom portion to secure said means ladder within said cabinet-like structure in a first position, and wherein said energizable means is electrically associated to a first alarm to effect energization of said energizable means upon activation of said fire alarm to release said ladder means for enabling extending of said ladder means in a second position, and means to enable grasping of said top plate to enable pivoting of said top plate relative to said cabinet-like structure to gain access to said released ladder wherein said foldable ladder comprises a bottom portion and a top portion.

2. An automatic escape ladder apparatus as set forth in claim 1 wherein said bottom portion of said escape ladder is pivotally mounted to a pivot hinge axle within said cabinet-like structure enabling said ladder to pivot relatively thereto and extend into elongate configuration.

3. An automatic escape ladder as set forth in claim 2 wherein said bottom plate to fixedly secured to said ladder at the bottom portion.

4. An automatic escape ladder apparatus as set forth in claim 3 wherein said top portion of said escape ladder includes at least one locking pin and said bottom portion of said escape ladders includes at least one spring latch wherein said top portion pivoting relative said bottom portion into an extended position enables interlocking of said locking pin with said spring latch to secure said ladder in said extended position.

5. An automatic escape ladder apparatus as set forth in claim 5 wherein said top portion of said ladder means and said bottom portion of said ladder means are interconnected by means of pivot hinge means secured to abuttable terminal ends of said top and bottom portion of said escape ladder.

* * * * *